US009126786B2

(12) United States Patent
Taki

(10) Patent No.: US 9,126,786 B2
(45) Date of Patent: Sep. 8, 2015

(54) IMAGE PROCESSING APPARATUS AND METHOD FOR GUIDING SHEET

(71) Applicants: KABUSHIKI KAISHA TOSHIBA, Tokyo (JP); TOSHIBA TEC KABUSHIKI KAISHA, Tokyo (JP)

(72) Inventor: Hiroyuki Taki, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/024,011

(22) Filed: Sep. 11, 2013

(65) Prior Publication Data

US 2015/0069694 A1 Mar. 12, 2015

(51) Int. Cl.

| | |
|---|---|
| ***B65H 5/22*** | (2006.01) |
| ***B65H 7/20*** | (2006.01) |
| ***B65H 9/00*** | (2006.01) |
| ***B65H 5/26*** | (2006.01) |
| *B65H 85/00* | (2006.01) |
| *B65H 1/30* | (2006.01) |

(52) U.S. Cl.

CPC .. *B65H 7/20* (2013.01); *B65H 5/26* (2013.01); *B65H 9/00* (2013.01); *B65H 1/30* (2013.01); *B65H 85/00* (2013.01); *B65H 2301/31* (2013.01); *B65H 2301/448* (2013.01); *B65H 2301/44552* (2013.01)

(58) Field of Classification Search

CPC ..... B65H 1/30; B65H 85/00; B65H 2301/31; B65H 2301/448; B65H 2301/44552

USPC ..... 271/9.02, 3.01, 301, 303

See application file for complete search history.

(56) References Cited

U.S. PATENT DOCUMENTS

| | | | | |
|---|---|---|---|---|
| 8,292,287 | B2 | 10/2012 | Iguchi et al. | |
| 2009/0154970 | A1* | 6/2009 | Yoshida et al. | 399/341 |
| 2011/0065574 | A1 | 3/2011 | Taguchi et al. | |
| 2011/0221183 | A1 | 9/2011 | Iguchi et al. | |
| 2011/0222131 | A1 | 9/2011 | Yahata et al. | |
| 2011/0222951 | A1 | 9/2011 | Yahata et al. | |

* cited by examiner

*Primary Examiner* — Howard Sanders

(74) *Attorney, Agent, or Firm* — Patterson & Sheridan, LLP

(57) ABSTRACT

An image processing apparatus includes a supplying section from which a sheet placed thereon is supplied into the image processing apparatus, a processing section configured to execute an image processing on an image formed on a sheet, a first storing section configured to store a sheet, a second storing section configured to store a sheet, a first conveying section configured to convey a sheet placed on the supplying section to the first storing section through the processing section, and a second conveying section configured to convey a sheet passing through the processing section to the second storing section and convey a sheet stored in the second storing section to a position at which the sheet from the supplying section enters the processing section.

20 Claims, 7 Drawing Sheets

IMAGE PROCESSING APPARATUS AND METHOD FOR GUIDING SHEET

FIELD

Embodiments described herein relate to an image processing apparatus such as an image forming apparatus for forming an image on a sheet and an erasing apparatus for erasing an image formed on a sheet.

BACKGROUND

An erasing apparatus that erases an image formed with an erasable toner or ink by heating the image to a given temperature so that the image can be erased and the sheet reused.

Such an erasing apparatus includes a sheet supplying section from which the sheet to be erased is supplied into the apparatus, an erasing section configured to erase an image by heating the image, a reading section configured to recognize a residual image remaining after the color erasing, and a sheet discharging section configured to store the sheet with the erased image. The conveying section in the erasing apparatus conveys a sheet from the sheet supplying section to the erasing section, the reading section, and the sheet discharging section in that order.

DETAILED DESCRIPTION

A number of sheets that a user of the apparatus wants processed and a number of sheets that are reusable after the erasing processing is performed are different depending on the purpose of the use. Thus, many sheets may need to be placed on a sheet supplying section by the user, or many sheets may be stacked in a tray for reusable sheets or a tray for non-reusable sheets in a sheet receiving section. Thus, there may be a situation in which sheets are placed in the sheet supplying section and accumulated there because the start button of the erasing apparatus is not pressed and a situation in which the tray for reusable sheets becomes full while the tray for non-reusable sheets has still some space after the erasing processing is performed.

When the number of sheets placed in the sheet supplying section exceeds an acceptable number, no more sheets can be placed until processing has started. Further, when the number of sheets stacked in the sheet receiving section exceeds an acceptable number, an erasing processing cannot be carried out until at least some of the sheets stacked in the sheet receiving section are taken out.

The embodiment is directed to creating space to store sheets so that too many sheets are not placed in the sheet supplying section and that sheets can be stored even when a tray of the sheet receiving section is full.

In accordance with one embodiment, an image processing apparatus includes a supplying section from which a sheet placed thereon is supplied into the image processing apparatus, a processing section configured to execute an image processing on an image formed on a sheet, a first storing section configured to store a sheet, a second storing section configured to store a sheet, a first conveying section configured to convey a sheet placed on the supplying section to the first storing section through the processing section, and a second conveying section configured to convey a sheet passing through the processing section to the second storing section and convey a sheet stored in the second storing section to a position at which the sheet from the supplying section enters the processing section.

First Embodiment

Figure 1:
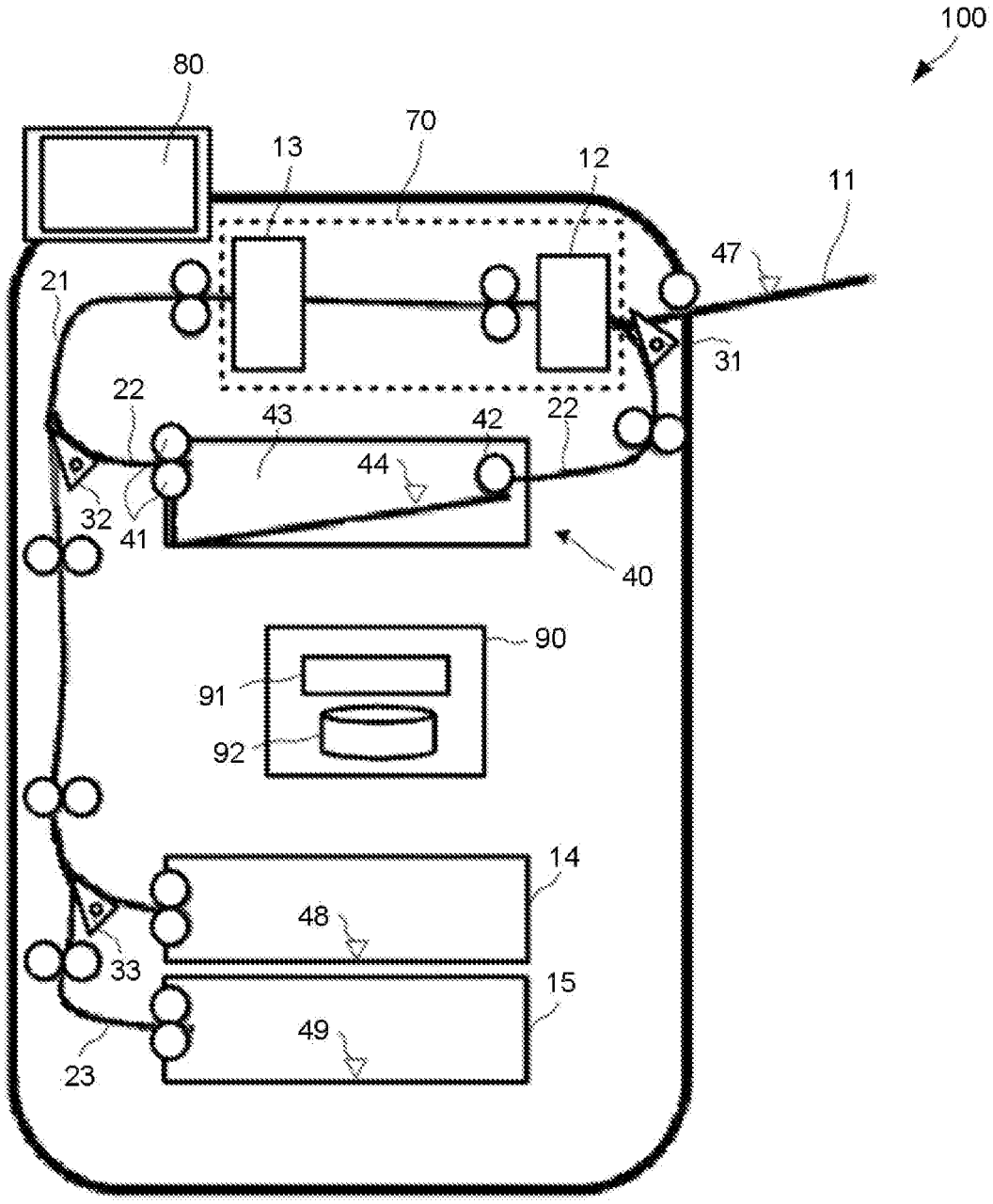
FIG. 1 is a schematic diagram illustrating a configuration of an erasing apparatus according to an embodiment.

FIG. 1 is a schematic diagram illustrating an erasing apparatus according to a first embodiment. The erasing apparatus 100 comprises a supplying tray 11, an erasing section 12, a reading section 13, a first tray 14, a second tray 15, a first conveyance path 21, a second conveyance path 22, a third conveyance path 23, a first switching member 31, a second switching member 32, a third switching member 33, a sheet stacking section 40, and an operation section 80. Behaviors of each of the hardware units are controlled by a control section 90 arranged in the internal erasing apparatus 100.

The supplying tray 11 holds sheets of different sizes for reuse. Each of the sheets stacked on the supplying tray 11 is a sheet on which an image is formed with a color-erasable recording material (toner or ink), which will be erased when heated to a given temperature or above. The supplying tray 11 includes a pickup roller for picking up a sheet from the stacked sheets. With using the pickup roller, the supplying tray 11 supplies sheets to the first conveyance path 21 formed in the erasing apparatus 100.

The first conveyance path 21 is a path through which a sheet is conveyed from the supplying tray 11 to a first tray 14. The first conveyance path 21 conveys the supplied sheet to the erasing section 12 while the first switching member 31 allows a sheet to pass from the supplying tray 11 to the erasing section 12.

The erasing section 12 is disposed along the first conveyance path 21 and configured to erase the image formed on the sheet conveyed thereto. The erasing section 12 heats the image on the sheet to a given color-erasing temperature while being in contacted with the conveyed sheet. In this way, the erasing section 12 erases the image formed of a recording material on the sheet. The erasing section 12 includes two erasing units, one of which is configured to erase images on a first side of a sheet and the other of which is configured to erase images on a second side of the sheet. Each of the erasing units has a heater lamp which generates heat when power is supplied. Thus, the erasing section 12 erases the images on two sides of a conveyed sheet through once conveyance.

The first conveyance path 21 conveys the sheet on which the erasing section 1 has conducted the erasing processing to the reading section 13. The reading section 13 comprises a reading unit such as a CCD (Charge Coupled Device) scanner, a CMOS sensor, and the like, which is disposed along the first conveyance path 21. In this embodiment, the reading section 13 disposed along the first conveyance path 21 and comprises two reading units. Thus, images formed on two sides of the conveyed sheet can be read. The control section 90, which will be described later, determines whether or not the sheet is a reusable sheet by processing the image on the sheet read by the reading section 13 after the image is processed by the erasing section 12.

The second switching member 32 is disposed at the downstream side with respect to the reading section 13 along the first conveyance path 21 as a switching section of the conveyance path. The second switching member 32 switches the conveyance path of the conveyed sheet. The second switching member 32 switches the conveyance path in the following way: guide the sheet conveyed along the first conveyance path 21 to the second conveyance path 22 or the first tray 14. The second conveyance path 22 bifurcates away from the first conveyance path 21 at the branching point where the second switching member 32 is disposed. The second conveyance path 22 bifurcated at the branching point merges with the first conveyance path 21 at which the first switching member 31 is disposed, i.e., a position between the supplying tray 11 and the erasing section 12.

A sheet stacking section 40 is disposed along the second conveyance path 22. The sheet stacking section comprises a discharging roller 41, a supplying roller 41, and a tray 43. The tray 43 is a member in which a sheet is held. The discharging roller 41 discharges the sheet conveyed along the second conveyance path 22 to the tray 43. The supplying roller 42 supplies the sheet held on the tray 43 towards the first switching member 31. As provided with the discharging roller 41 and the tray 43, the sheet stacking section 40 can work as a sheet receiving section in which the sheet on which an erasing processing has been performed is stored. Moreover, as provided with the supplying roller 42 and the tray 43, the sheet stacking section 40 can work as a sheet supplying section in which a sheet to be reused is stored.

In addition, the sheet stacking section 40 has a sensor 44 for detecting the quantity and the number of sheets stacked on the tray 43. The sensor 44 is, for example, a sensor for detecting an entire weight or an entire thickness of the stacked sheet or an amount of light transmitting through the stacked sheets when the light is irradiated towards the stacked sheets. Further, the supplying tray 11, the first tray 14, and the second tray 15 also have similar sensors 47-49 respectively as the sensor 44.

The first switching member 31 switches a source from which a sheet is conveyed to the erasing section 12, between the supplying tray 11 and the second conveyance path 22 according to an instruction from the control section 90. That is, the first switching member 31 switches the sheet supplying source between the supplying tray 11 and the sheet stacking section 40.

Along, the first conveyance path 21, a third switching member 33 is disposed downstream with respect to the second switching member 32. The third switching member 33 guides the sheet conveyed from upstream along the first conveyance path 21 to the first tray 14 or the third conveyance path 23. Along the third conveyance path 23, a sheet is conveyed to the second tray 15.

The first tray 14 receives a sheet with an erased image so that the sheet can be stored for reuse. The second tray 15 receives a sheet which is determined to be non-reusable. Further, types of sheet stored in the first tray 14 and the second tray 15 can be swapped with each other. The operation section 80 can carry out the setting of a type of the sheet to be stacked in each tray according to an input by a user. According to the setting, the third switching member 33 switches the conveyance path and guides the conveyed sheet to the first tray 14 or the second tray 15.

The operation section 80 is disposed at an upper part of the main body of the erasing apparatus 100 and has a touch panel type display section and operation keys such as a numeric key. The user operates functional behaviors of the erasing apparatus 100 using the operation section 80. The operation for the functional behaviors includes a setting of whether the sheet stacking section 40 is used as a sheet supplying section or a sheet receiving section and a setting of a conveyance route, which will be described later. Further, the operation section 80 displays setting information, a status of the operation, log information of the erasing apparatus 100, or a message to the user.

The control section 90 comprises a processor 91 and a storage section 92. The processor 91 is a CPU (Central Processing Unit) or an MPU (Micro Processing Unit), loads pre-stored programs into the storage section 92, and executes logic operations in accordance with the programs, thereby controlling each section of the erasing apparatus 100. The storage section 92 includes a ROM (Read Only Memory) for storing various control programs and a RAM (Random Access Memory) for providing a temporary working area for the processor 91. In addition, the storage section 92 has an HDD (Hard Disk Drive) for storing a setting content of the user permanently.

The processing section 70 includes the erasing section 12 and the reading section 13. The erasing section 12 executes an image processing of erasing an image formed on a sheet. The reading section 13 executes an image processing of reading the image formed on the sheet and converting the image into electronic data. The processing section 70 is assumed to have the erasing section 12 and the reading section 13 in this example, but it may have another processing section.

The reading section 13, which is configured in this example, may not be included if it is unnecessary to read images formed on sheets. In this case, the third switching member 33, the third conveyance path 23, and the second tray 15 are unnecessary either.

The conveyance route in the erasing apparatus 100 and exemplary actions thereof are described below with reference to each accompanying drawing. Further, the sheet conveyance direction is represented by the dotted arrow shown in FIG. 2, FIG. 3, and FIG. 5. The starting point of the dotted arrow lies at an upstream side of the sheet conveyance direction, and the ending point (arrowhead side) of the dotted arrow lies at a downstream side of the sheet conveyance direction.

Figure 2:
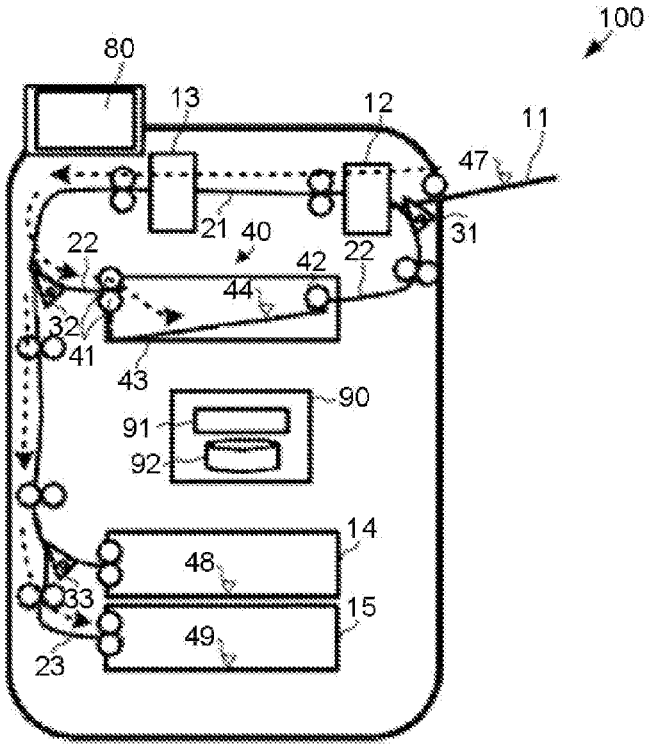
FIG. 2 illustrates a sheet conveyance of the erasing apparatus when a sheet stacking section serves as a sheet receiving section.

FIG. 2 shows a conveyance route when the sheet stacking section 40 serves as a sheet receiving section. In this case, the sheet, i.e., an erasing object, is supplied from the supplying tray 11 to the first conveyance path 21. At this time, the control section controls the first switching member 31 to guide sheet to be conveyed from the supplying tray 11 to the first conveyance path 21. Then, the sheet is conveyed in the first conveyance path 21, subject to an erasing processing in the erasing section 12, and to an image reading by the reading section 13. The control section 90 determines whether or not the sheet is reusable based on an image signal acquired by the reading section 13. If the control section 90 determines that the sheet is reusable, the second switching member 32 switches the route such that the sheet passing the reading section 13 goes to the second conveyance path 22 in accordance with an instruction from the control section 90. The sheet entering the second conveyance path 22 guided by the second switching member 32 is then stored in the tray 43 of the sheet stacking section 40. Further, if the control section 90 determines that the sheet is non-reusable, the second switching member 32 and the third switching member 33 switch the route and guide the sheet to the second tray 15 in accordance with an instruction from the control section 90. Further, the determination processing of whether or not the sheet is reusable can be carried out in the following way: the printing rate of a paper serving as an index for determining whether or not the sheet is reusable and a density threshold for determining whether or not an image can be erased are stored in the ROM in advance, and the control section 90 compares the density threshold with a density of the image acquired by the reading section 13 to determine whether or not the sheet is reusable. Further, if it is determined that the sheet is reusable using a corrugation depth in the image reading, a density threshold using for determining a corrugation depth may also be stored in the ROM.

Figure 3:
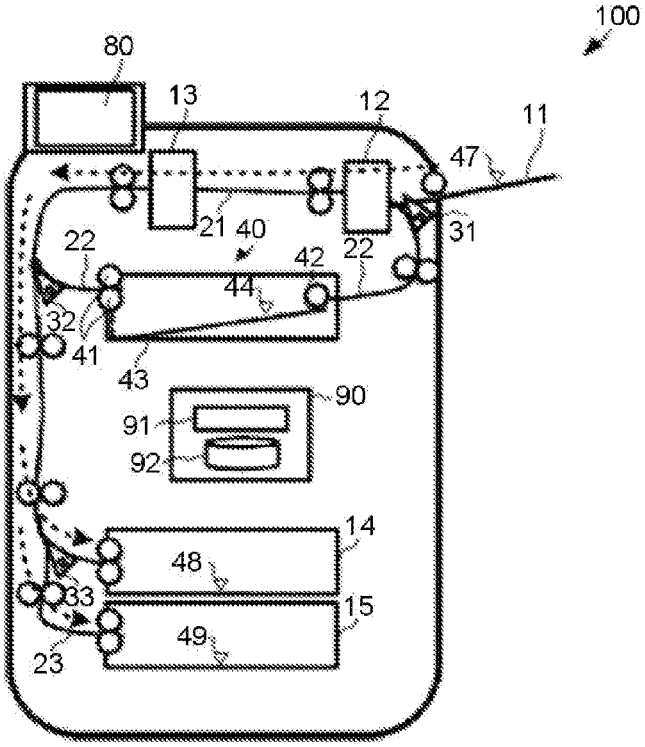
FIG. 3 illustrates a sheet conveyance of the erasing apparatus when the sheet stacking section serves as a sheet receiving section and the allowance number for sheet storage in the sheet stacking section is exceeded.

Further, if the sensor 44 of the sheet stacking section 40 detects that a number of stacked sheets exceeds an acceptable number, the control section 90 switches the second switching member 32 and the third switching member 33 to guide the processed sheet to the first tray 14. FIG. 3 shows a conveyance route of this behavior by arrows. That is, it is determined that the sheet is reusable and that the number of sheets stacked in the sheet stacking section 40 exceeds the acceptable number, then sheet is stacked in the first tray 14.

In this example, it is assumed that the sheet stacking section 40 stores the reusable sheet, but it may be a configuration in which the sheet stacking section 40 stores the non-reusable sheets and the first tray 14 (or the second tray 15) stores the reusable sheets. Further, in this example, sheets are discharged to the sheet stacking section 40 by default, and to the first tray 14 if the stacked number exceeds the acceptable number. However, the embodiment is not limited to this case. Thus, sheets may be also discharged to the first tray 14 by default, and to the sheet stacking section 40 when the sensor 48 detects that the number of sheets stacked in the first tray 14 exceeds the acceptable number.

The setting of the default or the discharging destination is carried out by a user operating the operation section 80. Each setting value is stored in the storage section 92, and the processor 91 acquires the setting values and carries out the control of the sheet supplying sources or the switching of the conveyance paths as needed.

Figure 4:
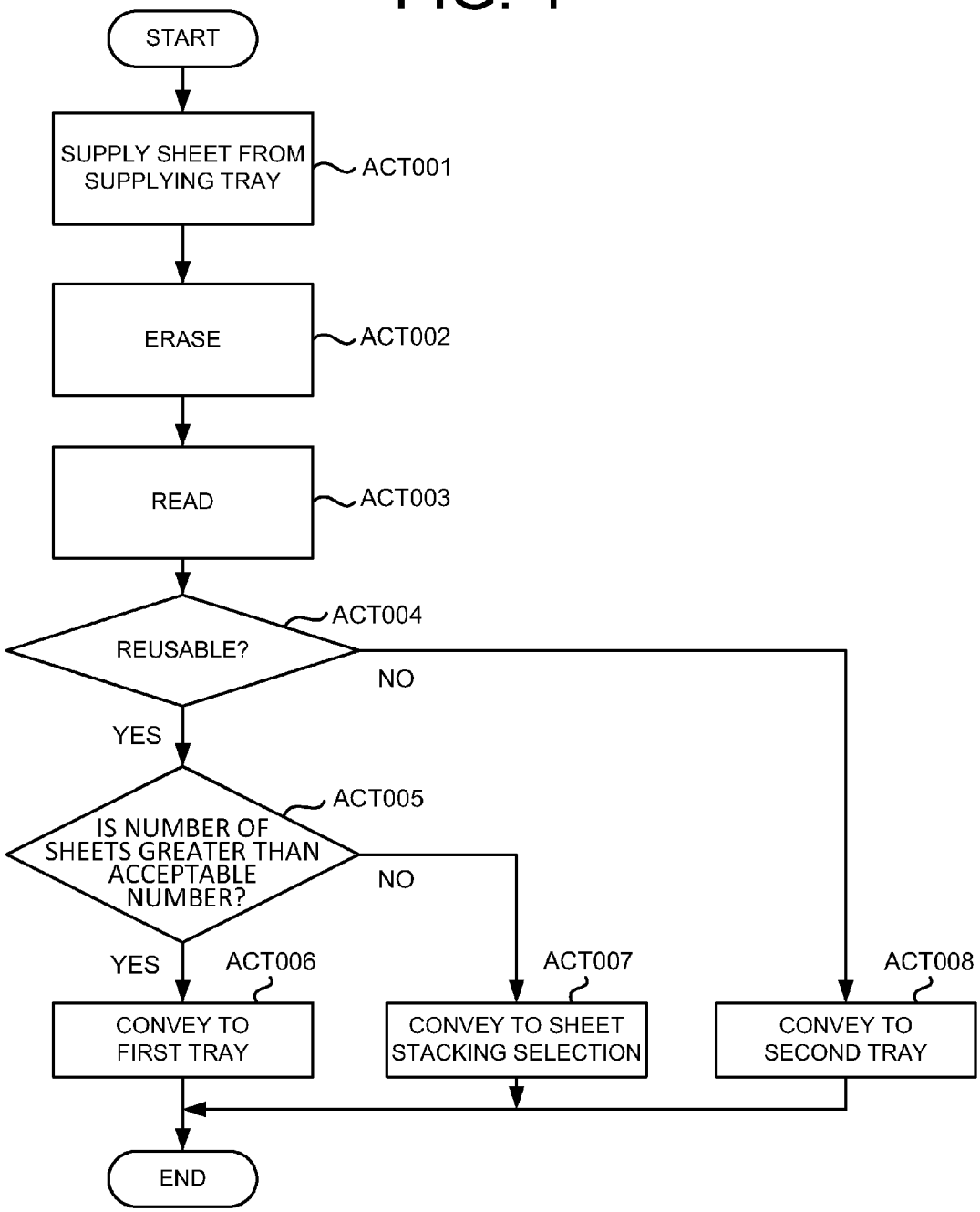
FIG. 4 is a flowchart illustrating processing of the erasing apparatus described in FIG. 2 and FIG. 3.

FIG. 4 is a flowchart illustrating the behaviors of the erasing apparatus 100 described in FIG. 2 and FIG. 3. The control on the behaviors is carried out by the control section 90. That is, the processor 91 in the control section 90 carries out the control by executing arithmetic on a program pre-stored in the storage section 92.

If the user presses down a start button in the operation section 80, then the control section 90 controls the roller of the supplying tray 11 to convey the sheet stacked on the supplying tray 11 to the main body part (ACT 001). The control section 90 controls the erasing section 12 so as to carry out the processing by which the image formed on the conveyed sheet is erased (ACT 002). The control section 90 controls the reading section 13 to read an image remaining on the sheet on which the erasing processing has been performed (ACT 003). The storage section 92 stores the read image data. The control section 90 acquires the image data read by the reading section 13 from the storage section 92 to carry out the determination of whether or not the sheet is reusable (ACT 004).

Further, if the control section 90 determines that the sheet is non-reusable (No in ACT 004), the control section 90 controls the second switching member 32 and the third switching member 33 to switch the conveyance routes to guide the sheet to the second tray 15 (ACT 008). After determining that the sheet is reusable (Yes in ACT 004), the control section 90 determines whether or not the number of sheets stacked in the sheet stacking section 40 exceeds the acceptable number based on an output signal from the sensor 44 (ACT 005). If the control section 90 determines that the number exceeds the acceptable number (Yes in ACT 005), the control section 90 carries out a switching control on the second switching member 32 and the third switching member 33 to guide the sheet to the first tray 14 (ACT 006). If the control section 90 determines that the number of sheets stacked in the sheet stacking section 40 does not exceed the acceptable number (No in ACT 005), the control section 90 carries out a switching control on the second switching member 32 to guide the sheet to the sheet stacking section 40 (ACT 007).

The control section 90 carries out the processing shown in FIG. 4 with respect to each object sheet stacked in the supplying tray 11.

Figure 5:
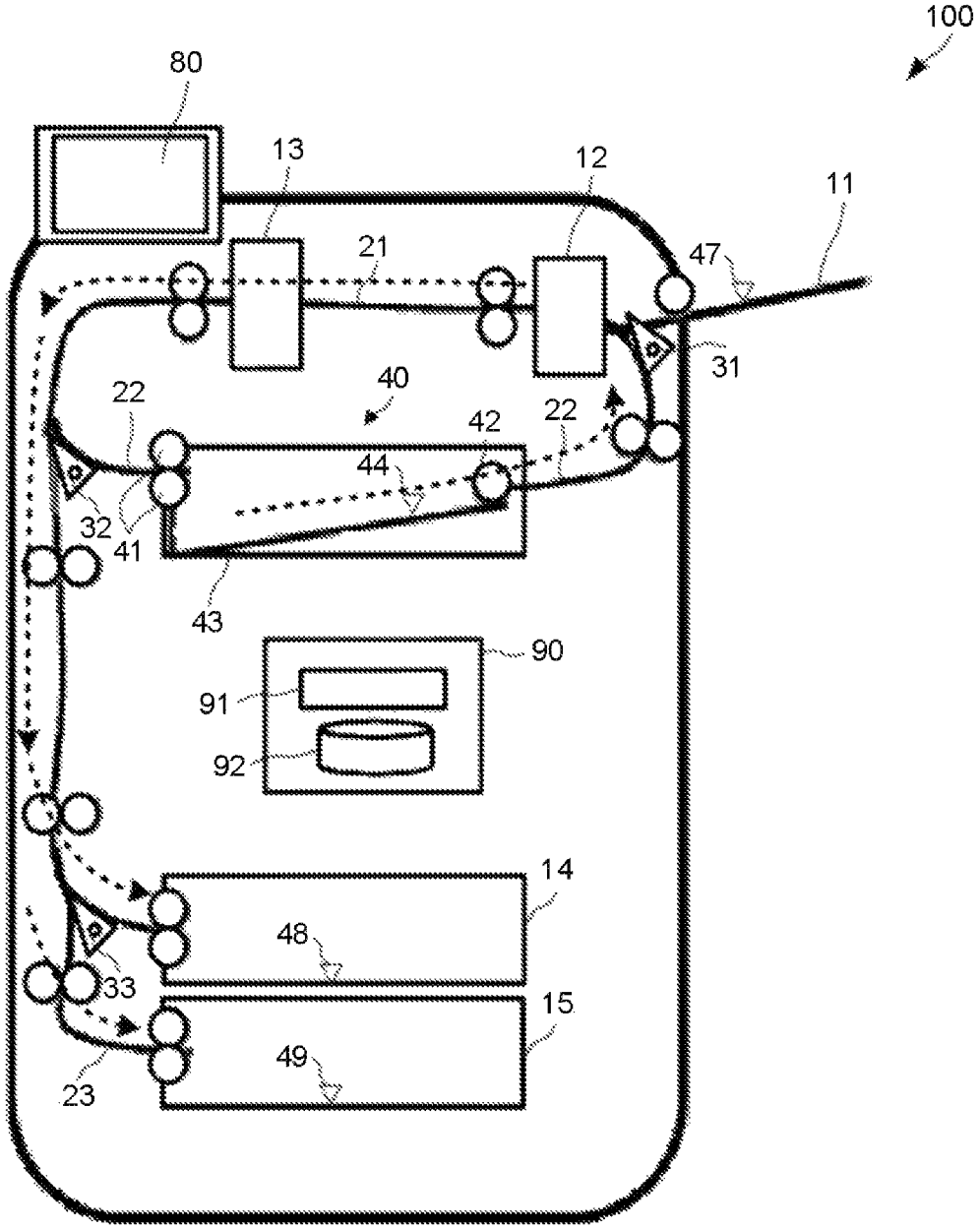
FIG. 5 illustrates a sheet conveyance of the erasing apparatus when the sheet stacking section serves as a sheet supplying section.

Next, FIG. 5 illustrates a sheet conveyance route when the sheet stacking section 40 serves as a sheet supplying section. The user stacks the sheet on which an erasing processing for reuse has not been performed to the tray 43 of the sheet stacking section 40. The supplying roller 42 picks up the stacked sheets one by one and conveys the sheet along the second conveyance path 22 towards the first switching member 31. The first switching member 31 guides the sheets conveyed along the second conveyance path 22 to the first conveyance path 21 according to an instruction from the control section 90. In this way, the sheet from the sheet stacking section 40 enters the first conveyance path 21, and is conveyed to the erasing section 12 and then read by the reading section 13 after the erasing processing.

The second switching member 32 switches the route in such a manner that the sheet is guided towards the third switching member 33 but not to the second conveyance path 22. In this way, the sheet is conveyed towards the third switching member 33. Then, the sheet is stored either of the first tray 14 and the second tray 15 according to the switching of the third switching member 33 based on the image data acquired by the reading section 13.

If the sensor 44 detects that there is no sheet in the tray 43 of the sheet stacking section 40, the erasing apparatus 100 carries out a sheet supplying from the supplying tray 11. The control section 90 carries out a switching control on the first switching member 31 to guide sheets from the supplying tray 11 to the erasing section 12. In this case, the sheet conveyance route is the same as that shown in FIG. 3.

In this example, it is described that sheets are supplied from the sheet stacking section 40 by default, and if there is no sheet in the sheet stacking section 40, sheets are supplied from the supplying tray 11. However, the embodiment is not limited to this case. It may be also set that sheets are supplied from the supplying tray 11 by default. In this case, if the sensor 47 of the supplying tray 11 detects that there is no sheet, the sheet supplying is switched to be from the sheet stacking section 40.

The setting of the default or the sheet supply source is carried out by the user operating the operation section 80. Each setting value is stored in the storage section 92, and the processor 91 acquires the setting values and carries out the control of the sheet supplying source or the switching of the conveyance paths as needed.

Figure 6:
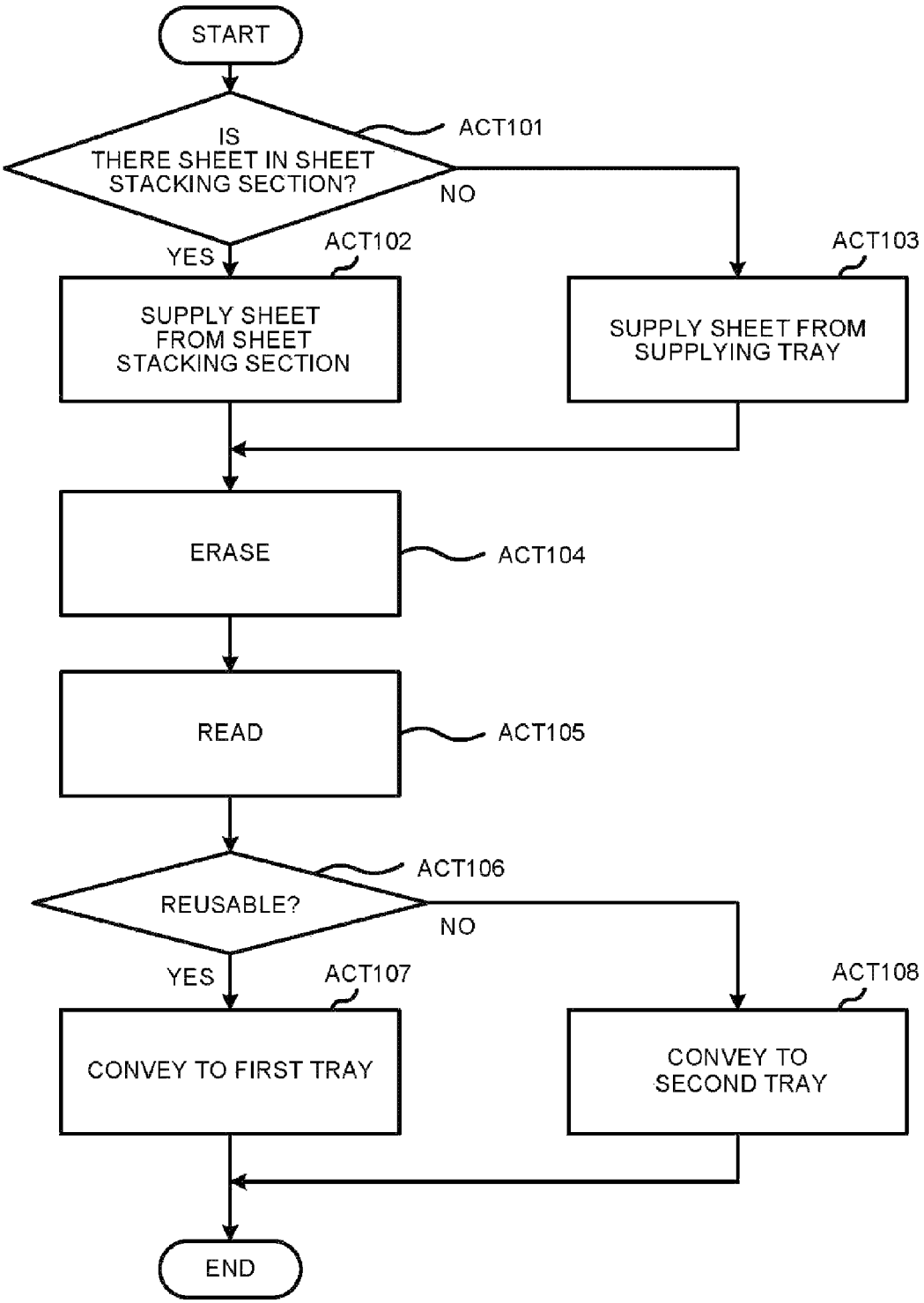
FIG. 6 is a flowchart illustrating processing of the erasing apparatus described in FIG. 5.

FIG. 6 is a flowchart illustrating the behaviors of the erasing apparatus 100 described in FIG. 5. The control on the behaviors is carried out by the control section 90. That is, the processor 91 in the control section 90 executes the arithmetic on a program pre-stored in the storage section 92.

If the user presses down a start button on the operation section 80, then the control section 90 determines whether or not there is a sheet in the sheet stacking section 40 based on an output signal from the sensor 40 (ACT 101). If the control section 90 determines that there is a sheet in the sheet stacking section 40 (Yes in ACT 101), the control section 90 controls the supplying roller 42 to pick up the sheet stacked in the sheet stacking section 40. Further, the control section 90 controls the first switching member 31 so that the sheet from the sheet stacking section 40 is conveyed (ACT 102). On the other hand, if there is no sheet in the sheet stacking section 40 (No in ACT 101), the control section 90 controls the rollers of the supplying tray 11 to pick up the sheet stacked on the supplying tray 11. Further, the control section 90 controls the first switching member so that the sheet from the supplying tray 11 is conveyed (ACT 103).

The erasing section 12 carries out an erasing processing on the sheet supplied from the supplying tray 11 or the sheet stacking section 40 according to an instruction from the control section 90 (ACT 104). The reading section 13 reads the sheet on which the erasing processing is performed according to an instruction from the control section (ACT 105). The storage section 92 stores the acquired image data, and the control section 90 determines whether or not the sheet is reusable based on the image data (ACT 106). If the control section 90 determines that the sheet is reusable (Yes in ACT 106), the control section 90 controls the second switching member 32 and the third switching member 33 to switch the conveyance routes so as to convey the sheet to the first tray 14 (ACT 107). If the control section 90 determines that the sheet is non-reusable (No in ACT 106), the control section 90 controls the second switching member 32 and the third switching member 33 to guide the sheet to the second tray 15 (ACT 108).

The control section 90 carries out each processing shown in FIG. 6 with respect to each of the sheets stacked in the supplying tray 11 or the sheet stacking section 40.

The stacking section having the functions of both a sheet supplying section and a sheet receiving section, is disposed in the erasing apparatus in this example, and the stacking section may be also applicable to an image forming apparatus.

Figure 7:
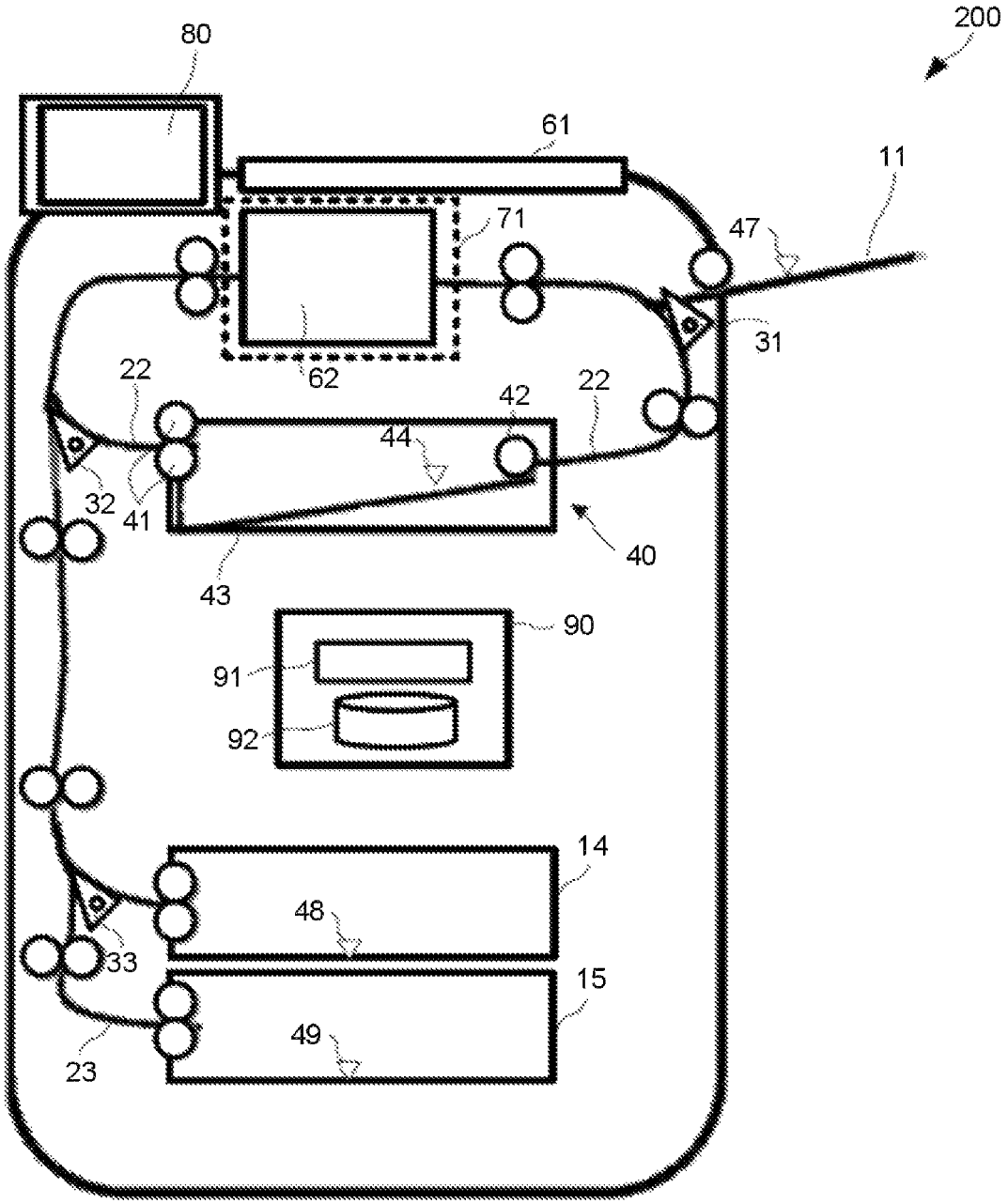
FIG. 7 is a schematic diagram illustrating a configuration of an image forming apparatus according to an embodiment.

FIG. 7 is a schematic diagram illustrating an image forming apparatus having the sheet stacking section. The image forming apparatus 200 includes the aforementioned sheet stacking section 40. Further, the image forming apparatus 200 also has an original reading section 61 and a printing section 62. The original reading section 61 is at least has a transmission plate on which an original sheet or a book to be read is placed, a light emitter for radiating light towards the original, and a scanner for receiving light reflecting from the original and converting the reflecting light into electronic data. The printing section 62 is a processing section 71 for executing an image processing of forming an image on a surface of a sheet. The printing section 62 prints the original image read by the original reading section 61 or the image data sent from an external personal computer on the surface of the sheet. The printing section 62 is comprised of, for example, toner cartridges, a photoconductor, an exposure body, a sheet transferring device, and a heating fixer. A toner which will be erased at a given temperature or above may be housed in one of the toner cartridges, and a general toner which will not be erased may be also housed in one of the toner cartridges.

The image forming apparatus has a printing section 62 (processing section 71) and an original reading section 61 instead of the processing section 70 of the erasing apparatus 100 including the erasing section 12 and the reading section 13. In addition, the other configuration of the image forming apparatus is the same as that of the erasing apparatus 100. Further, the second tray 15 may not be included in the image forming apparatus 200, and the third switching member 33 and the third conveyance path 23 may not be included in the image forming apparatus 200 in accordance with this.

The embodiment which the sheet stacking section serves as a sheet supplying section or sheet receiving section and the conveyance route are the same as that in the erasing apparatus 100.

Second Embodiment

In a second embodiment, a plate is disposed above a tray of the sheet stacking section such that the sheet discharged from the discharging roller can be stored thereon. Further, sheet is stored in the tray of the sheet stacking section, and the sheet stored in the tray is supplied into the apparatus by a supplying roller.

Figure 8:
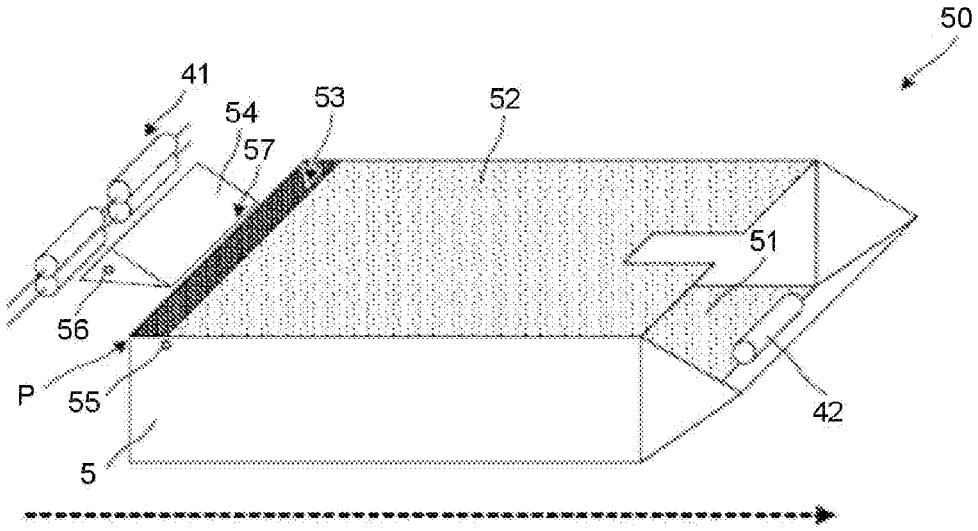
FIG. 8 illustrates a sheet stacking section of an apparatus according to a second embodiment.
Figure 9:
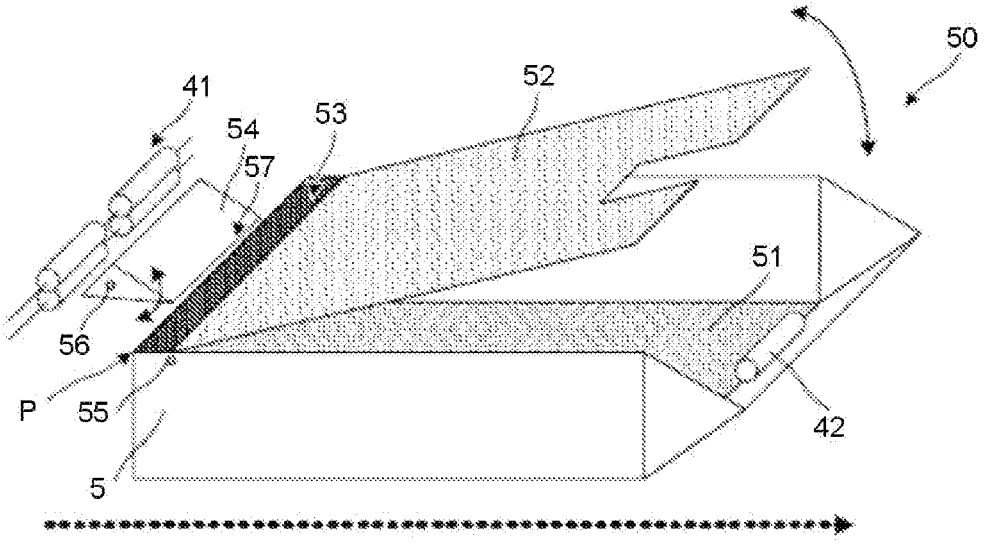
FIG. 9 illustrates a state in which the top of the sheet stacking section shown in FIG. 8 is open.

FIG. 8 and FIG. 9 illustrate a configuration of the sheet stacking section according to the second embodiment. The dotted arrows shown on the lower parts of FIG. 8 and FIG. 9 represent the conveyance direction of the sheet along the second conveyance path 22. Instead of the sheet stacking section 40 described in the first embodiment, the erasing apparatus or image forming apparatus according to the second embodiment has a sheet stacking section 50 shown in FIG. 8.

The sheet stacking section 50 has a tray 5 and a fourth switching member 54 and, as described in the first embodiment, a discharging roller 41 and a supplying roller 42. The tray 5 includes a lower surface plate 51 forming a lower surface of the tray and an upper surface plate 52 forming an upper surface of the tray. The upper surface plate 52 holds a sheet discharged from the discharging roller 41. The lower surface plate 51 stores sheets to be supplied through the supplying roller 42 to the main body of the erasing apparatus 100. That is, sheets on which an erasing processing for reuse have not been performed are stored on the lower surface plate 51, and sheet on which an erasing processing has been performed are stacked on the upper surface plate 52. With the configuration above, the sheet stacking section 50 can function as both a supplying tray and a receiving tray at the same time.

The behaviors of the erasing apparatus 100 according to the second embodiment are described. The supplying roller 42 supplies the sheet on the lower surface plate 51 of the sheet stacking section 50 to the second conveyance path 22. The sheet entering the first conveyance path 21 is orderly conveyed to the erasing section 12 and the reading section 13, and will be conveyed to the second conveyance path 22 again if the sheet is reusable. Then, the sheet is stacked on the upper surface plate 51 of the sheet stacking section 50 by the discharging roller 41. The control section 90 controls rollers along each conveyance path as well as the switching of the first switching member 31 and the second switching member 32.

The upper surface plate 52 is fixed on main body side walls of the tray 5 by projection members, each of which pierces a side wall of the tray 5 in the end portion of the upper stream side of the upper surface plate 52 hooked on the side wall hole of the tray 5. That is, the projection disposed in the side wall hole of the tray 5 is a shaft 55, which works as a rotation shaft of the upper surface plate 52. The upper surface plate 52, which is opposite to and parallel to the lower surface plate 51 (refer to FIG. 8) when in use, the side of the supplying roller 42 can be widely opened by the user rotating the upper surface plate 52 around the shaft 55 as the rotation axis (refer to FIG. 9). Thus, it is easy to set or take out sheet on or from the lower surface plate 51.

A slit portion 53 having a width wider than the sheet conveyed is formed on the upper surface of the tray 5. The slit portion 53 allows a conveyed sheet to be conveyed to the lower surface plate 51 and to be stored thereon. The shaft 55 is located at a position separated from the corner portion P of the tray 5 along the conveyance direction. Because of the gap resulting from the separation, the slit portion 53 is formed.

The fourth switching member 54 is disposed between the discharging roller 41 and the tray 5. The fourth switching member 54 rotates around a shaft 56 according to an instruction from the control section 90, thus, the end portion 57 can rotationally move up and down by the fourth switching member 54 swinging around the shaft 56 as its rotation axis (refer to FIG. 9). When the end portion 57 is located at an upper position, the sheet discharged from the discharging roller 41 is stacked on the upper surface plate 52 by passing and striding over the slit portion 53. When the end portion 57 is located at a lower position, the sheet discharged from the discharging roller 41 is stacked on the lower surface plate 51 through the slit portion 53. Thus, by disposing the fourth switching member 54 and forming the slit portion 53, the conveyance path shown in FIG. 2 can be formed.

The sheet stacking section 50 described in the second embodiment is also applicable to the image forming apparatus 200 as well as the erasing apparatus 100 described in the first embodiment. That is, a sheet stacking section may be used for both a sheet receiving section and a sheet supplying section.

The image processing apparatus includes the erasing apparatus 100 and the image forming apparatus 200 described in the embodiments. The sheet supplying section includes the supplying tray 11 described in the embodiments. The processing section includes the erasing section 12, the reading section 13, and the printing section 62 described in the embodiments. The sheet receiving section includes the first tray 14 (or the second tray 15) described in the embodiments. The first conveying section includes the first conveyance path 21 described in the embodiments. The second conveying section includes the second conveyance path 22 described in the embodiments. The first switching member includes the second switching member 32 described in the embodiments. The second switching member includes the first switching member 31 described in the embodiments.

Further, the 'color-erasing processing (erasing processing) ', which refers to the erasing of the color of an image in the description given herein, further include the erasing of an image. That is, the erasing apparatus described herein is not limited to an apparatus for thermally erasing the color of an image. For example, the erasing apparatus may be an apparatus for erasing the color of an image on a sheet through light radiation or an apparatus for erasing the image formed on a special sheet. Alternatively, the erasing apparatus may be also an apparatus for getting rid of (erasing) an image on a sheet. In order to make a sheet reusable, the erasing apparatus can have any configuration that can make the image formed on the sheet disappeared.

As stated above, according to the technology provided herein, the function of the sheet stacking section can be modified according to the purpose of the user of the apparatus. Therefore, a processing of the apparatus may not be negatively affected by accumulation of sheets in the sheet supplying section or in the sheet receiving section, and the usability of the apparatus is enhanced.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a supplying section from which a sheet placed thereon is supplied into the image processing apparatus;

a processing section configured to execute an image processing on an image formed on a sheet;

a first storing section configured to store a sheet;

a second storing section configured to store a sheet;

a first conveying section configured to convey a sheet placed on the supplying section to the first storing section through the processing section;

a second conveying section configured to convey a sheet passing through the processing section to the second storing section and convey a sheet stored in the second storing section to a position at which the sheet from the supplying section enters the processing section;

a switching member configured to guide a sheet passing through the processing section to either the first storing section or the second storing section; and a control section configured to switch the switching member, so that a sheet passing through the processing section is guided to the second storing section if a number of sheets stored in the first storing section is more than a first number or if a number of sheets stored in the second storing section is less than a second number.

2. The image processing apparatus according to claim 1, wherein the second storing section is disposed along a sheet conveyance path between the switching member and the processing section in a sheet conveying direction.

3. The image processing apparatus according to claim 1, further comprising:

a reading section configured to read a surface of the sheet passing through the processing section, wherein the image processing is image erasing processing, and the control section is further configured to determine whether or not the sheet is reusable based on a reading result of the reading section.

4. The image processing apparatus according to claim 3, wherein the control section switches the switching member so that the sheet passing through the processing section is guided to the second storing section, if the control section determines that the sheet is reusable and if the number of sheet stored in the first storing section is more than the first number.

5. An image processing apparatus comprising:

a supplying section from which a sheet placed thereon is supplied into the image processing apparatus;

a processing section configured to execute an image processing on an image formed on a sheet;

a first storing section configured to store a sheet;

a second storing section configured to store a sheet;

a first conveying section configured to convey a sheet placed on the supplying section to the first storing section through the processing section;

a second conveying section configured to convey a sheet passing through the processing section to the second storing section and convey a sheet stored in the second storing section to a position at which the sheet from the supplying section enters the processing section;

a switching member configured to guide a sheet passing through the processing section to either the first storing section or the second storing section; and a control section configured to switch the switching member, so that a sheet passing through the processing section is guided to the first storing section if a number of sheets stored in the first storing section is less than a first number or if a number of sheets stored in the second storing section is more than a second number.

6. The image processing apparatus according to claim 5, wherein the second storing section is disposed along a sheet conveyance path between the switching member and the processing section in a sheet conveying direction.

7. The image processing apparatus according to claim 5, further comprising:

a reading section configured to read a surface of the sheet passing through the processing section, wherein the image processing is image erasing processing, and the control section is further configured to determine whether or not the sheet is reusable based on a reading result of the reading section.

8. The image processing apparatus according to claim 7, wherein the control section switches the switching member so that the sheet passing through the processing section is guided to the second storing section, if the control section determines that the sheet is reusable and if the number of sheet stored in the first storing section is more than the first number.

9. An image processing apparatus comprising:

a supplying section from which a sheet placed thereon is supplied into the image processing apparatus;

a processing section configured to execute an image processing on an image formed on a sheet;

a first storing section configured to store a sheet;

a second storing section configured to store a sheet;

a first conveying section configured to convey a sheet placed on the supplying section to the first storing section through the processing section;

a second conveying section configured to convey a sheet passing through the processing section to the second storing section and convey a sheet stored in the second storing section to a position at which the sheet from the supplying section enters the processing section;

a switching member configured to switch between a first position and a second position; and a control section configured to switch the switching member, wherein a sheet supplied from the supplying section is guided to the processing section if the switching member is in the first position, a sheet supplied from the second storing section is guided to the processing section if the switching member is in the second position, and the control section is further configured to cause the switching member to be in the first position if there is no sheet in the second storing section.

10. The image processing apparatus according to claim 9, wherein the second storing section is disposed along a sheet conveyance path between the processing section and the switching member in a sheet conveying direction.

11. The image processing apparatus according to claim 9, further comprising:

a reading section configured to read a surface of the sheet passing through the processing section, wherein the image processing is image erasing processing, and the control section is further configured to determine whether or not the sheet is reusable based on a reading result of the reading section.

12. The image processing apparatus according to claim 11, wherein the control section is further configured to cause the sheet passing through the reading section to be conveyed to the first storing section when the control section determines that the sheet is reusable.

13. An image processing apparatus comprising:

a supplying section from which a sheet placed thereon is supplied into the image processing apparatus;

a processing section configured to execute an image processing on an image formed on a sheet;

a first storing section configured to store a sheet;

a second storing section configured to store a sheet;

a first conveying section configured to convey a sheet placed on the supplying section to the first storing section through the processing section;

a second conveying section configured to convey a sheet passing through the processing section to the second storing section and convey a sheet stored in the second storing section to a position at which the sheet from the supplying section enters the processing section;

a switching member configured to switch between a first position and a second position; and a control section configured to switch the switching member, wherein a sheet supplied from the supplying section is guided to the processing section if the switching member is in the first position, a sheet supplied from the second storing section is guided to the processing section if the switching member is in the second position, and the control section is further configured to cause the switching member to be in the second position if there is no sheet in the supplying section.

14. The image processing apparatus according to claim 13, wherein the second storing section is disposed along a sheet conveyance path between the processing section and the switching member in a sheet conveying direction.

15. The image processing apparatus according to claim 13, further comprising:

a reading section configured to read a surface of the sheet passing through the processing section, wherein the image processing is image erasing processing, and the control section is further configured to determine whether or not the sheet is reusable based on a reading result of the reading section.

16. The image processing apparatus according to claim 15, wherein the control section is further configured to cause the sheet passing through the reading section to be conveyed to the first storing section when the control section determines that the sheet is reusable.

17. An image processing apparatus comprising:

a supplying section from which a sheet placed thereon is supplied into the image processing apparatus;

a processing section configured to execute an image processing on an image formed on a sheet;

a first storing section configured to store a sheet;

a second storing section configured to store a sheet;

a first conveying section configured to convey a sheet placed on the supplying section to the first storing section through the processing section;

a second conveying section configured to convey a sheet passing through the processing section to the second storing section and convey a sheet stored in the second storing section to a position at which the sheet from the supplying section enters the processing section;

a switching member configured to guide a sheet passing through the processing section to either the first storing section or the second storing section, wherein the second storing section includes a first subsection and a second subsection, each of which is configured to store a sheet, and the second conveying section is further configured to convey a sheet passing through the processing section to the first subsection and to convey a sheet stored in the second subsection to the position at which a sheet from the supplying section enters the processing section.

18. The image processing apparatus according to claim 17, wherein the second storing section is disposed along a sheet conveyance path between the processing section and the switching member in a sheet conveying direction.

19. The image processing apparatus according to claim 17, wherein the image processing is image erasing processing, the apparatus further comprising:

a reading section configured to read a surface of the sheet passing through the processing section; and a control section configured to determine whether or not the sheet is reusable based on a reading result of the reading section.

20. The image processing apparatus according to claim 19, wherein the control section is further configured to cause the sheet passing through the reading section to be conveyed to the first subsection when the control section determines that the sheet is reusable.

* * * * *